US005114368A

United States Patent [19]

Moyle et al.

[11] Patent Number: 5,114,368

[45] Date of Patent: May 19, 1992

[54] SHAFT SHIELDING TOP LOADER

[76] Inventors: Don R. Moyle, Rte. 1, Box 1762; Glendon L. Dilworth, 1215 E. 16th, both of, Burley, Id. 83318

[21] Appl. No.: 681,432

[22] Filed: Apr. 1, 1991

Related U.S. Application Data

[63] Continuation of Ser. No. 449,977, Dec. 12, 1989, abandoned.

[51] Int. Cl.[5] ..... B63H 11/103

[52] U.S. Cl. ..... 440/47; 440/38; 440/46

[58] Field of Search ..... 440/38, 47, 41, 46, 440/40, 42, 43; 114/270; 60/221, 222

[56] References Cited

U.S. PATENT DOCUMENTS

| | | | |
|---|---|---|---|
| 3,082,732 | 3/1963 | Stallman | 440/41 |
| 3,302,605 | 2/1967 | Kuether | 440/46 |
| 3,387,583 | 6/1968 | Kuether | 440/46 |
| 3,752,110 | 8/1973 | Rhoda | 440/47 |
| 3,757,728 | 9/1973 | Rhoda | 440/47 |
| 3,805,731 | 4/1974 | Furst et al. | 440/47 |
| 3,943,876 | 3/1976 | Kiekhaefer | 440/47 |
| 4,373,919 | 2/1983 | Strangeland | 440/47 |
| 4,775,341 | 10/1988 | Tyler et al. | 440/47 |

FOREIGN PATENT DOCUMENTS

| | | | |
|---|---|---|---|
| 2222982 | 11/1972 | Fed. Rep. of Germany | 440/38 |
| 1016293 | 11/1952 | France | 440/38 |
| 237290 | 9/1989 | Japan | 114/270 |
| 1062126 | 12/1983 | U.S.S.R. | 440/38 |
| 1087794 | 10/1967 | United Kingdom | 440/38 |

*Primary Examiner*—Sherman D. Basinger
*Assistant Examiner*—Thomas J. Brahan
*Attorney, Agent, or Firm*—Frank J. Dykas; Craig M. Korfanta; Ken J. Pedersen

[57] ABSTRACT

A shaft shielding top loader (20) for use in the inlet water channel (12) of a water craft (10) is disclosed. Shaft shielding top loader (20) is configured to divide the incoming water into an upper portion and a lower portion, where the upper portion supplies the top of impeller (13). This is accomplished using an arcuate top loading plate (21) supported by a shaft shielding partition (22). Shaft shielding partition (22) is configured to have a trailing straight edge which is colinearly juxtapositioned with respect to impeller drive shaft (14) to shield impeller drive shaft (14) from the force of the incoming water. Shaft shielding top loader (20) is attached entirely within inlet water channel (12) using a suitable attachment device, such as a screw, at grate connecting adapter plate (24) and shoe plate (26). Shaft shielding top loader (20) insures a continuous water supply to impeller (13) regardless of the craft's orientation to the flow of incoming water.

2 Claims, 8 Drawing Sheets

SHAFT SHIELDING TOP LOADER

This application is a continuation of application Ser. No. 07/449,977, filed Dec. 12, 1989, now abandoned.

BACKGROUND OF THE INVENTION

1. Technical Field

This invention generally relates to devices for directing water in the inlet channels of jet pump drives and in particular it relates to a water directing device known as a top loader having a centralized vertical supporting partition which shields the impeller drive shaft from incoming water pressure.

2. Background Art

Jet pump drives are routinely used as a propulsion means water craft. With the advent of personal water craft, for example the JET SKI by KAWASAKI, there has been an increased interest in maximizing the performance of the jet pump drives.

RHODA, U.S. Pat. No. 3,757,728, discloses what is commonly known as a top loader. A top loader divides the incoming flow of water into two or more portions and directs part of the water to the upper portion of the impeller. This increases the efficiency of the impeller and reduces cavitation. Likewise, STANGELAND, U.S. Pat. No. 4,373,919, teaches an adjustable angle top loading plate.

These and similar devices possess several disadvantages. The first major problem is that the top loading plates are supported along their edges by a pair of side support plate members. When the water craft enters a turn, the side members are presented sideways with respect to the flow of incoming water. This sideways presentation greatly reduces the volume of water directed into the jet drive inlet and significantly decreases impeller efficiency. The second problem inherent in these devices is that they generally require that a portion of the top loader project outwardly from the bottom hull of the water craft which increases the drag significantly. As applied to personal water craft, the protruding portion is a potential safety hazard.

A third problem is that the force of the incoming water in the water intake inlet is applied directly to the impeller drive shaft which extends through the water inlet. The force of the incoming water can actually cause the drive shaft to move and impact the attached impeller with the impeller housing.

What is needed is top loader which increases the water intake during a turn and a means for shielding the drive shaft from the forces of incoming water.

It is therefore an object of the present invention to provide a top loading assembly which increases the efficiency of the jet drive while turning and protects the impeller drive shaft from the forces of incoming water.

DISCLOSURE OF INVENTION

These and other objects are accomplished by a shaft shielding top loader which has a single arcuate top loading plate generally concave in the up direction and relatively horizontally disposed within the water intake channel and supported by a single relatively vertically disposed central partition which also acts to shield the impeller drive shaft from the forces of incoming water.

The present invention contemplates two different embodiments, one for use in personal water craft and a second embodiment for use on larger jet pump drives common to jet boats. The personal water craft embodiment of the shaft shielding top loader is generally installed in place of the conventional grate assembly which covers the water intake. It should be noted however that the shaft shielding top loader could be fitted in the water inlet channel behind the grate assembly if desired. Both embodiments are designed to be placed entirely within their respective water inlet channels so that, although it is situated at the opening of the water inlet channel, no portion of the shaft shielding top loader protrudes outwardly from the hull of the craft.

BEST MODE FOR CARRYING OUT INVENTION

Figure 1:
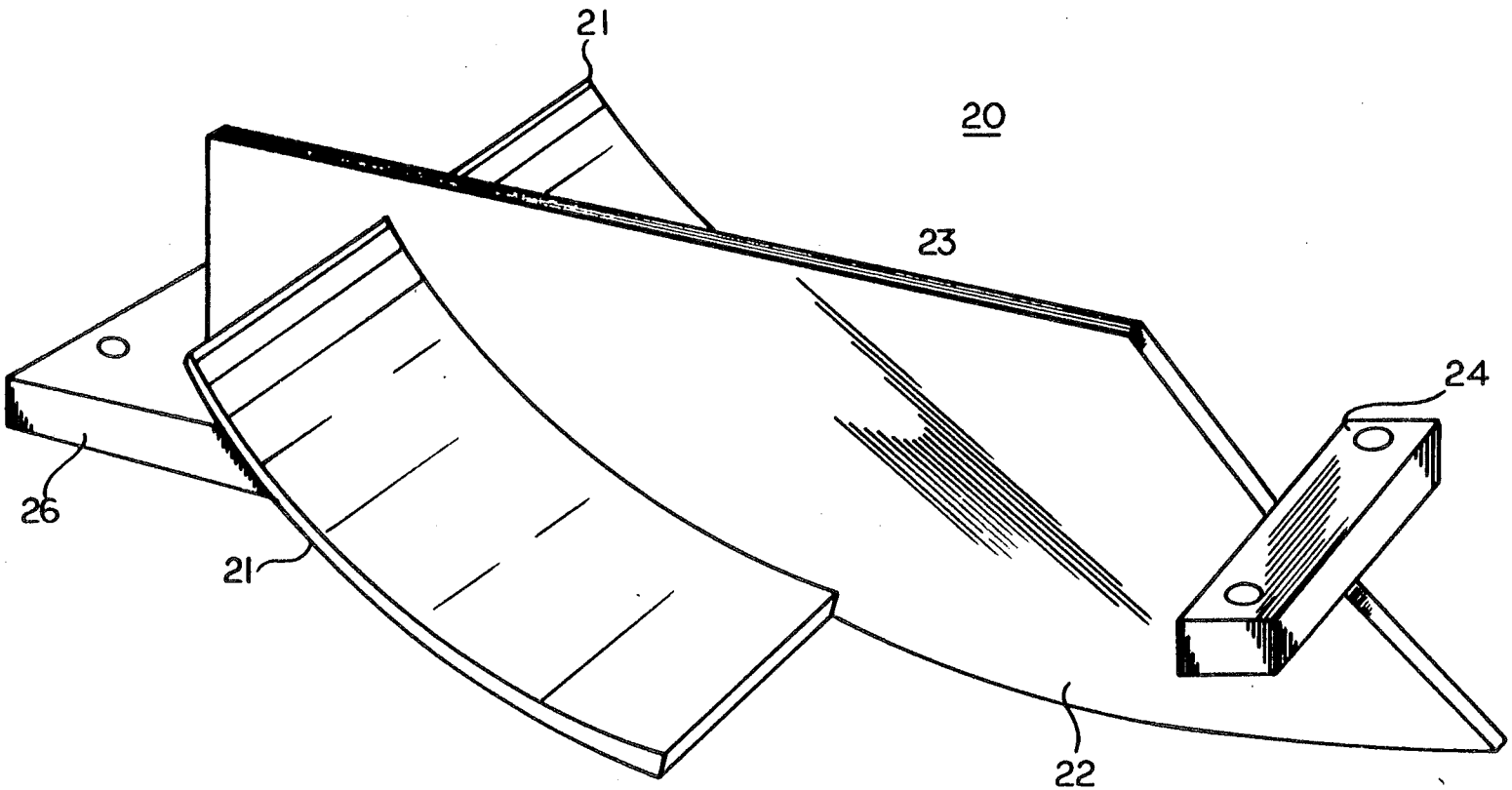
FIG. 1 is a three-quarter elevation view of a first embodiment of the shaft shielding top loader.
Figure 2:
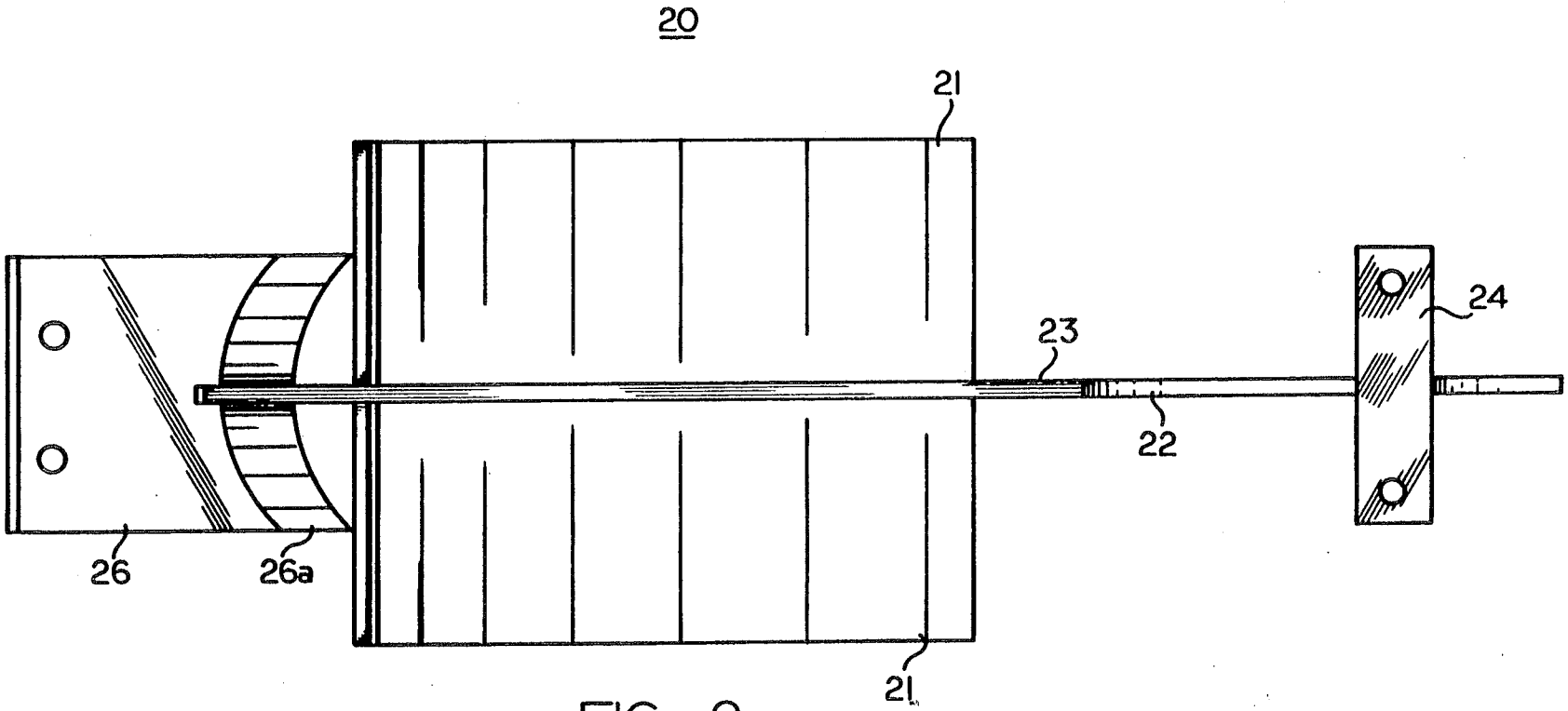
FIG. 2 is a top view of the first embodiment of the shaft shielding top loader.
Figure 3:
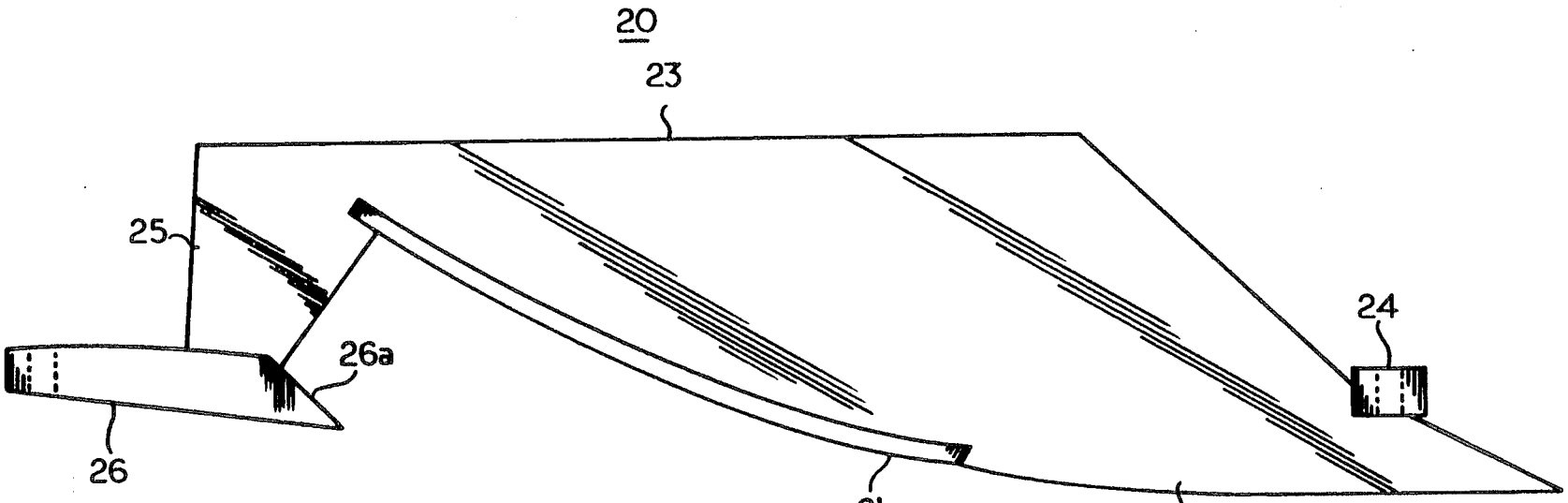
FIG. 3 is a right side view of the first embodiment of the shaft shielding top loader.

Referring now to FIGS. 1–4, a first embodiment of the shaft shielding top loader 20 is shown. Shaft shielding top loader 20 here is specifically designed for use in a personal water craft 10 and takes the place of the conventional water inlet grate (not shown). It should be noted however that shaft shielding top loader 20 could be easily configured to be used in connection with a standard inlet grate.

Personal water craft 10 generally has water inlet 11 which supplies water to impeller 13 through inlet water channel 12. Impeller 13 is rotationally driven via impeller drive shaft 14 which receives its rotational power from a drive means 17, normally a gasoline engine. Water is propelled by impeller 13 through impeller housing 15 and out steering nozzle 16.

Shaft shielding top loader 20 here consists of a single arcuate top loading plate 21 which is contoured to be generally concave in the up direction and relatively horizontally disposed within inlet water channel 12. Arcuate top loading plate 21 is supported and held in place by a single, relatively vertically disposed shaft shielding partition 22. Shaft shielding partition 22 is configured to have a straight shaft facing edge 23 which is colinearly disposed in juxtaposition with impeller drive shaft 14. Shaft shielding partition 22 and arcuate top loading plate 21 are attached within inlet water channel 12 by grate connecting adapter plate 24 and shoe plate 26. Shoe plate 26 is here attached to a depending support tab portion 25 of shaft shielding partition 22. Shoe plate 26 is of standard configuration which includes a beveled front edge **26*a***, both of which are well known in the art.

Figure 4:
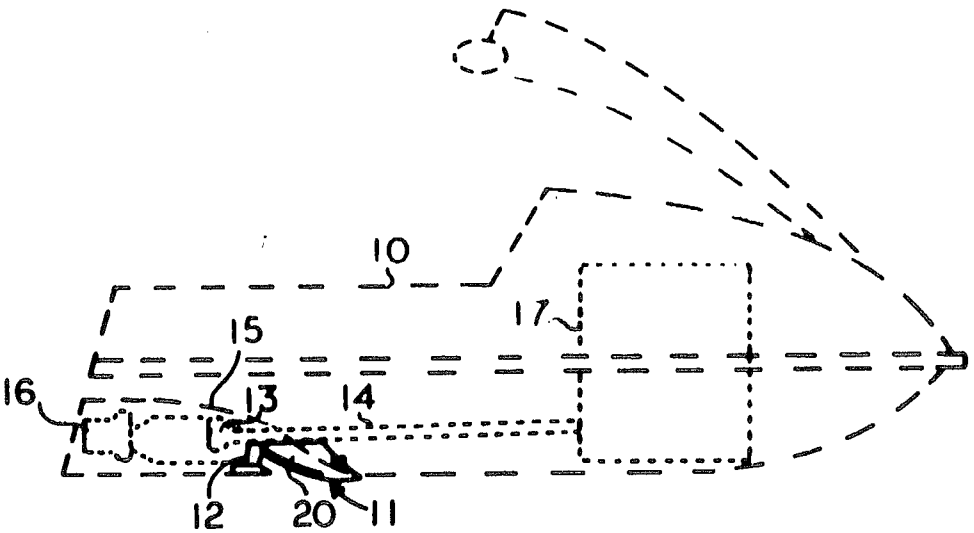
FIG. 4 is a representational side view of a personal water craft having the first embodiment of the shaft shielding top loader installed therein.
Figure 5:
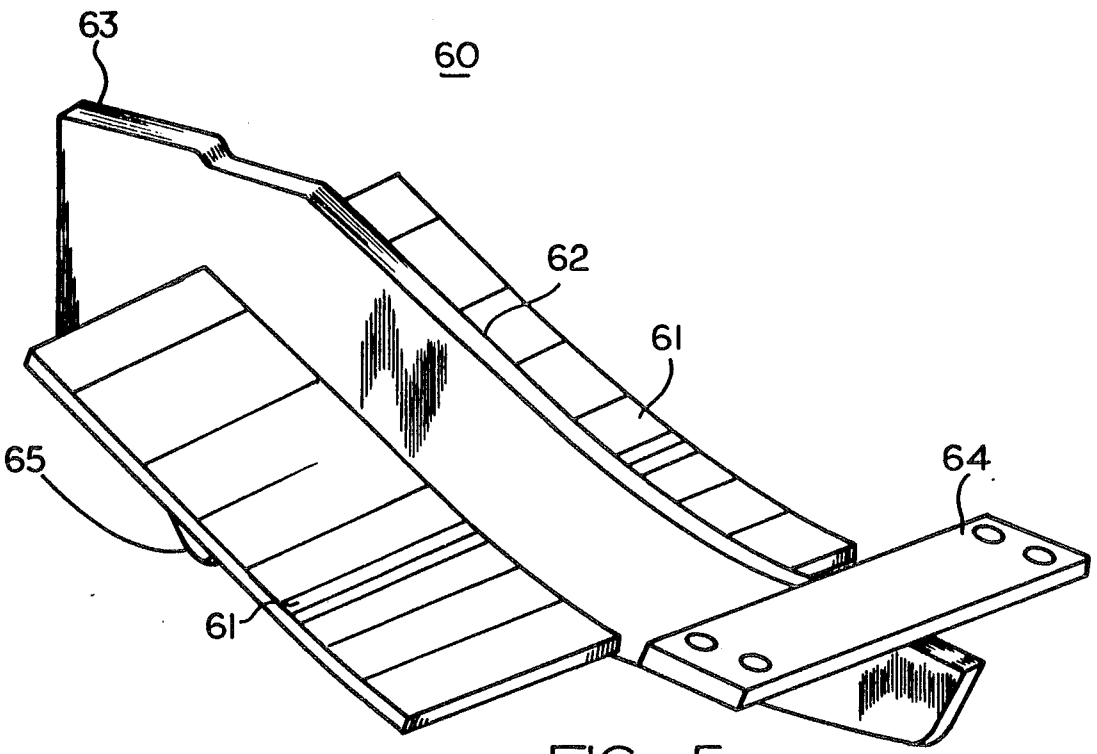
FIG. 5 is a three-quarter elevation view of a second embodiment of the shaft shielding top loader.
Figure 6:
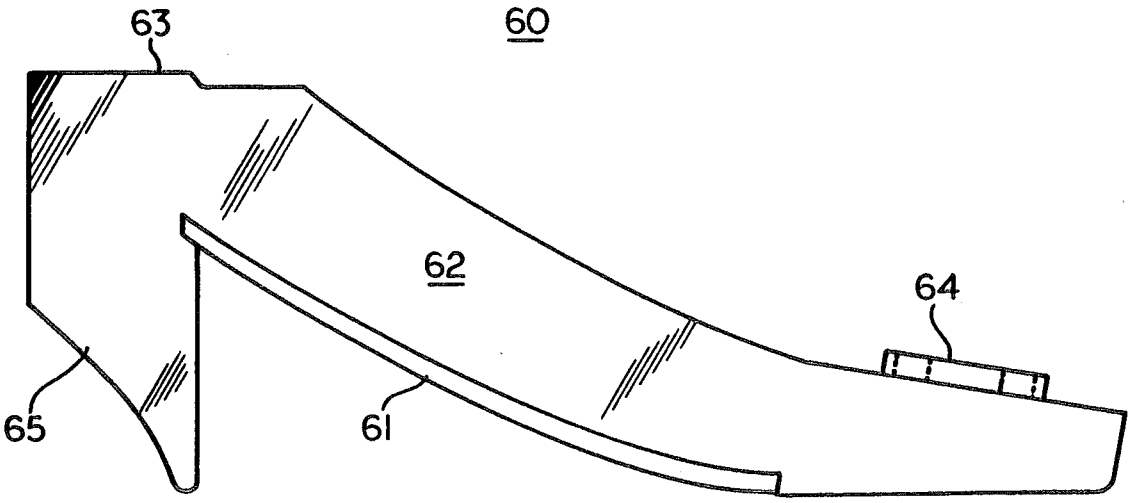
FIG. 6 is a right side view of the second embodiment of the shaft shielding top loader.
Figure 7:
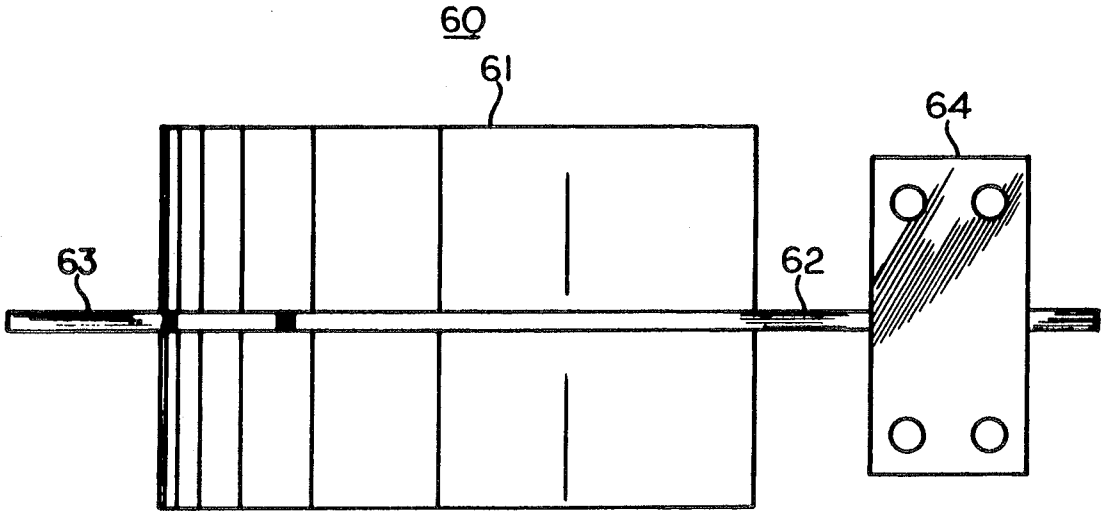
FIG. 7 is a top view of the second embodiment of the shaft shielding top loader.
Figure 8:
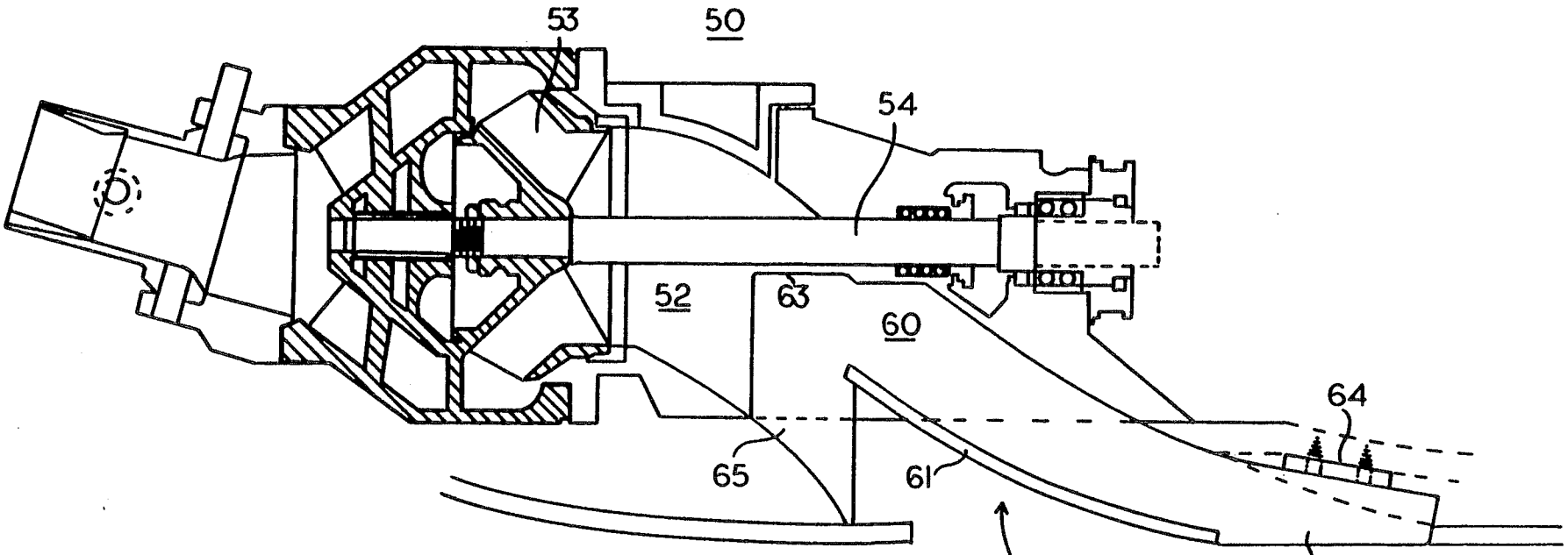
FIG. 8 is a sectional right side view of a jet boat drive having the second embodiment of the shaft shielding top loader installed therein.

As can be seen from FIG. 4, the first embodiment of shaft shielding top loader 20 is attached at the opening of but within water inlet channel 12 using a suitable attachment means, such as screws, at grate connecting adapter plates 24 and shoe plate 26. By utilizing the central shaft shielding partition 22, which is disposed relatively vertically and perpendiculaity with respect to relatively horizontally disposed arcuate top loading plate 21, at least one portion of inlet 11 and inlet water channel 12 will always be accessible to incoming water regardless of the craft's orientation. This insures a constant water supply to impeller 13. Additionally, the water is divided into two vertical portions by shaft shielding partition 22 and directed around impeller drive shaft 14, thereby greatly reducing the pressure exerted on impeller drive shaft 14 by the force of the incoming water.

Referring now to FIGS. 5 through 8, a second embodiment of shaft shielding top loader 60 is shown. Shaft shielding top loader 60 is specifically designed for use in the inlet water channel 52 of a jet boat jet pump drive 50. Shaft shielding top loader 60 is disposed within inlet water channel 52 such that, although it is situated at the opening of the water inlet channel, no portion of shaft shielding top loader 60 protrudes outwardly from inlet 51. Analogous to the personal water craft embodiment, an impeller drive shaft 54 is disposed within inlet water channel 52 and supplies rotational power to impeller 53.

Shaft shielding top loader 60 has an arcuate top loading plate 61 also generally concave in the up direction and relatively horizontally disposed within inlet water channel 52 to divide the incoming water into an upper portion and a lower portion, where the upper portion supplies the top of impeller 53. Single shaft shielding partition 62 is relatively vertically attached to the upper surface of arcuate top loading plate 61 in a perpendicular relationship. Shaft shielding partition 62 includes a straight shaft facing edge 63 which is colinearly juxtapositioned with respect to impeller drive shaft 54. A grate connecting adapter plate 64 is attached to a front portion of shaft shielding partition 62 for attaching shaft shielding top loader 60 at the opening of, but retirely within inlet water channel 52. Shaft shielding partition 62 also includes a depending support tab portion 65 which acts to support the trailing end of shaft shielding top loader 60. Again, shaft shielding top loader 60 is attached at the opening of, but entirely within inlet water channel 52 using a suitable attachment means, such as screws, at grate connecting adapter plate 64.

While there is shown and described the present preferred embodiment of the invention, it is to be distinctly understood that this invention is not limited thereto but may be variously embodied to practice within the scope of the following claims.

We claim:

1. A shaft shielding top loader for use in a watercraft propelled by a jet pump means, said jet pump means including a water inlet channel, an impeller and an impeller drive shaft being disposed in said channel, which comprises:

a single actuate top loading plate generally concave in the up direction having a top surface and a bottom surface and being relatively horizontally disposed within said water inlet channel to divide said channel into an upper impeller portion and a lower impeller portion;

a single shaft shielding partition being centrally and vertically attached within said inlet and aligned with said drive shaft, said partition further being normally attached to the top surface of said top loading plate; and said shaft shielding partition having a straight shaft facing edge which is disposed in close spaced relation parallel and in juxtaposition with the impeller drive shaft.

2. The shaft shielding top loader of claim 1 wherein said top loader is placed at the opening of, but entirely within, said water inlet channel so that no portion of the top loader protrudes outwardly from the hull of the watercraft.

* * * * *